US007153170B1

(12) United States Patent
Fabian

(10) Patent No.: US 7,153,170 B1
(45) Date of Patent: Dec. 26, 2006

(54) ELECTRICAL CONNECTOR ASSEMBLY HAVING AT LEAST TWO KEYING ARRANGEMENTS

(75) Inventor: David James Fabian, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/461,149

(22) Filed: Jul. 31, 2006

(51) Int. Cl.
*H01R 13/10* (2006.01)

(52) U.S. Cl. ..... 439/680; 439/295; 439/284

(58) Field of Classification Search ..... 439/680, 439/284, 295, 290–293, 287, 701, 488–491, 439/681, 358, 352
See application file for complete search history.

(56) References Cited

U.S. PATENT DOCUMENTS 4,376,565 A * 3/1983 Bird et al. ..... 439/681
4,778,411 A 10/1988 Rudy, Jr. et al.
4,832,625 A * 5/1989 Puerner ..... 439/681
5,370,557 A 12/1994 Olsson
6,364,718 B1 * 4/2002 Polgar et al. ..... 439/680
6,884,106 B1 * 4/2005 Shuman et al. ..... 439/358
7,108,534 B1 * 9/2006 Fabian ..... 439/284

* cited by examiner

*Primary Examiner*—Truc T. Nguyen
*Assistant Examiner*—Edwin A. Leon

(57) ABSTRACT

An electrical connector assembly has a first and a second electrical connector. Each electrical connector includes a housing having electrical contacts therein wherein each contact of the first electrical connector mates or connects with a corresponding contact of the second electrical connector. A keying arrangement has keying surfaces for inhibiting the mating except for mating a first electrical connector to a designated second electrical connector. Another keying arrangement is provided by two pairs of electrical contact housings fitted within interior cavities of the first and second electrical connectors. Each electrical contact housing includes a key sized to slip fit into an opposing opening of an electrical contact housing fitted within an interior cavity of either the first or second electrical connector. Each key is arranged so that the first and second electrical connector housings will mate only when the four keys are in mating alignment with their respective opening.

20 Claims, 7 Drawing Sheets

10
12
16
20
22
23a
56
A
B
20a1
20c1
20b1
26
20b2
23b
106
108
102
100b
62
65a
64
30
62b1
62c1
62a1
28
100a
130
62a2
88
14
60
65b
42
40
50
38
C

ELECTRICAL CONNECTOR ASSEMBLY HAVING AT LEAST TWO KEYING ARRANGEMENTS

FIELD OF THE INVENTION

The present disclosure is directed to a keying arrangement for electrical connector assemblies that prevent inadvertent mating of connector halves that are not intended to be mated.

BACKGROUND OF THE INVENTION

In electrical equipment having multiple modules or units that are interconnected, it is desirable to provide a keying system that uniquely defines plug and receptacle pairs that are to be mated. There are many such systems in use in the industry. For example, U.S. Pat. No. 4,778,411 discloses mating electrical connector housings having hexagonal nests formed therein containing hexagonal shaped keys that are positionable in any of six unique angular positions. Each housing has a key that is in axial alignment with a corresponding key in the other housing. Mating of the two housings is prevented unless the two keys are in mutually complimentary angular positions. The shanks of the keys include an undercut that mates with an inwardly facing bead on the interior of the nest and a split end to provide a snap action when the keys are pressed into their seats.

U.S. Pat. No. 5,370,557 discloses a keying arrangement for low profile electrical connectors. The opposing ends of a mating plug and receptacle have polygonal openings formed completely through their housings that contain opposing polygonal-shaped keys that are axially aligned. Each of the keys is retained in its respective polygonal opening by a pair of wing-like flanges extending from the key that overlies a first surface formed in the housing adjacent the polygonal opening and a locking tab projecting from the key that underlies another surface spaced from the first surface.

Additional keying arrangements are needed which are novel in design and structure over prior art keying arrangements. In particular, what is needed is a connector keying arrangement having a novel design and structure that effectively prevents inadvertent mating of the contacts of a first connector with the contacts of a second connector in an electrical connector assembly when the electrical ratings of the first and second connectors are different. What is also needed is a connector locking arrangement having a novel design and structure that effectively connects and interlocks the two connectors of the electrical connector assembly.

SUMMARY OF THE INVENTION

It is an aspect of the present disclosure to provide keying arrangements for an electrical connector assembly having two connector housings, i.e., a first and a second connector, which are hermaphroditic or genderless.

It is also an aspect for the keying arrangements to work effectively for preventing inadvertent mating or connecting of the electrical contacts of a first connector having a particular electrical rating with the electrical contacts of a second connector having a different electrical rating.

In the present disclosure, an electrical connector assembly is disclosed having first and second electrical connectors which are hermaphroditic or genderless, i.e., the two electrical connectors are substantially identical. One difference is the corresponding keying surface for each electrical connector is laterally reversed with respect to the other electrical connector. For ease of describing herein the connection of the two electrical connectors of the electrical connector assembly, the first electrical connector is referred to as a plug and the second electrical connector as a receptacle for illustration purposes, even though either electrical connector can be referred to as the plug and receptacle since the electrical connectors are hermaphroditic as stated above.

Each plug and receptacle includes a housing having electrical contacts therein wherein each contact of the plug contacts a corresponding contact of the receptacle. A first keying arrangement is provided for polarizing to assure proper orientation of the plug with the receptacle during connection thereof.

A second keying arrangement is provided by the electrical connector assembly for inhibiting or preventing the mating of two identical connector housings, e.g., a battery connector housing to another battery connector housing. The second keying arrangement includes a keying surface formed on a face of the plug and a corresponding keying surface formed on an opposing face of the receptacle so that when a plug and a receptacle are in axial alignment, the keying surfaces of the two connector housings interlock.

A third keying arrangement is provided to prevent inadvertent mating of the electrical contacts of the plug having a particular electrical rating with the electrical contacts of the receptacle having a different electrical rating. The third keying arrangement is provided in part by two pairs of electrical contact housings where each electrical contact housing is fitted within a respective interior cavity of one of the electrical connector housings. In one embodiment, each electrical contact housing fitted within an interior cavity of the receptacle includes a key having a rectangular shaped outer surface that is sized to slip fit into a respective opposing rectangular shaped opening of a respective electrical contact housing fitted within an interior cavity of a plug having the same electrical rating as the receptacle.

Likewise, each electrical contact housing fitted within an interior cavity of the plug having the same electrical rating as the receptacle includes a respective key having a rectangular shaped outer surface that is sized to slip fit into an opposing rectangular shaped opening of a respective electrical contact housing fitted within the interior cavity of the receptacle having the same electrical rating as the plug. Each key is arranged so that the plug and receptacle housings will mate only when the four keys are in mating alignment with their respective opening and the two connector housings are in axial alignment.

To prevent inadvertent mating of the electrical contacts of a plug having a particular electrical rating with the electrical contacts of a receptacle having a different electrical rating, the spacing between cavities of connector housings having different electrical ratings is different. This prevents axial alignment and hence mating of the keys of electrical contact housings fitted within a plug with the keys of electrical contact housings fitted within a receptacle where the receptacle has a different electrical rating than the plug. A locking arrangement is provided by the first keying arrangement for locking the receptacle and the plug and thereby locking each key within its respective opening when the receptacle and plug have the same electrical ratings.

The present invention further relates to an electrical connector assembly including a first and a second electrical connector connectable along a first axis. Each electrical connector includes a housing configured and dimensioned for receiving a pair of electrical contact housings. Each electrical contact housing has electrical contacts therein, wherein each electrical contact of the first electrical connector contacts a corresponding contact of the second electrical connector during connection thereof. A first keying arrangement is provided for polarizing to assure proper orientation of the first electrical connector with the second electrical connector during connection thereof. A second keying arrangement is provided for inhibiting the connection except for connecting a first electrical connector to a designated second electrical connector. The second keying arrangement includes a first keying surface defined by the first electrical connector housing and a second keying surface defined by the second electrical connector housing. The first and second keying surfaces are substantially complementary with respect to each other for enabling connection of the first and second electrical connector housings along the first axis when the housings are in axial alignment. A third keying surface and a fourth keying surface each extend adjacent the first keying surface of the first electrical connector. A fifth keying surface and a sixth keying surface each extend adjacent the second keying surface of the second electrical connector, the third, fourth, fifth and sixth keying surfaces each defining an axis parallel to the first axis when the housings are in axial alignment. The third keying surface engages the fifth keying surface and the fourth keying surface engages the sixth keying surface when the housings are connected.

The present invention yet further relates to an electrical connector assembly including a first and a second electrical connector connectable along an axis. Each electrical connector includes a housing configured and dimensioned for receiving a pair of electrical contact housings, each electrical contact housing having electrical contacts therein. Each electrical contact of the first electrical connector contacts a corresponding contact of the second electrical connector during connection thereof. A first keying arrangement is provided for polarizing to assure proper orientation of the first electrical connector with the second electrical connector during connection thereof. A second keying arrangement is provided for inhibiting the connection except for connecting a first electrical connector to a designated second electrical connector. The second keying arrangement includes a first keying surface defined by the first electrical connector housing and a second keying surface defined by the second electrical connector housing. The first and second keying surfaces are substantially complementary with respect to each other for enabling connection of the first and second electrical connector housings along the axis when the housings are in axial alignment. A first pair of keying surfaces extend adjacent the first keying surface of the first electrical connector and a second pair of keying surfaces extend adjacent the second keying surface of the second electrical connector. The first pair of keying surfaces and corresponding second pair of keying surfaces are in axial alignment when the housings are in axial alignment. The first pair of keying surfaces engage the corresponding second pair of keying surfaces when the housings are connected.

An advantage of the present invention is that the total number of parts to fabricate the enclosure is reduced.

A further advantage of the present invention is that the enclosure size is reduced.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
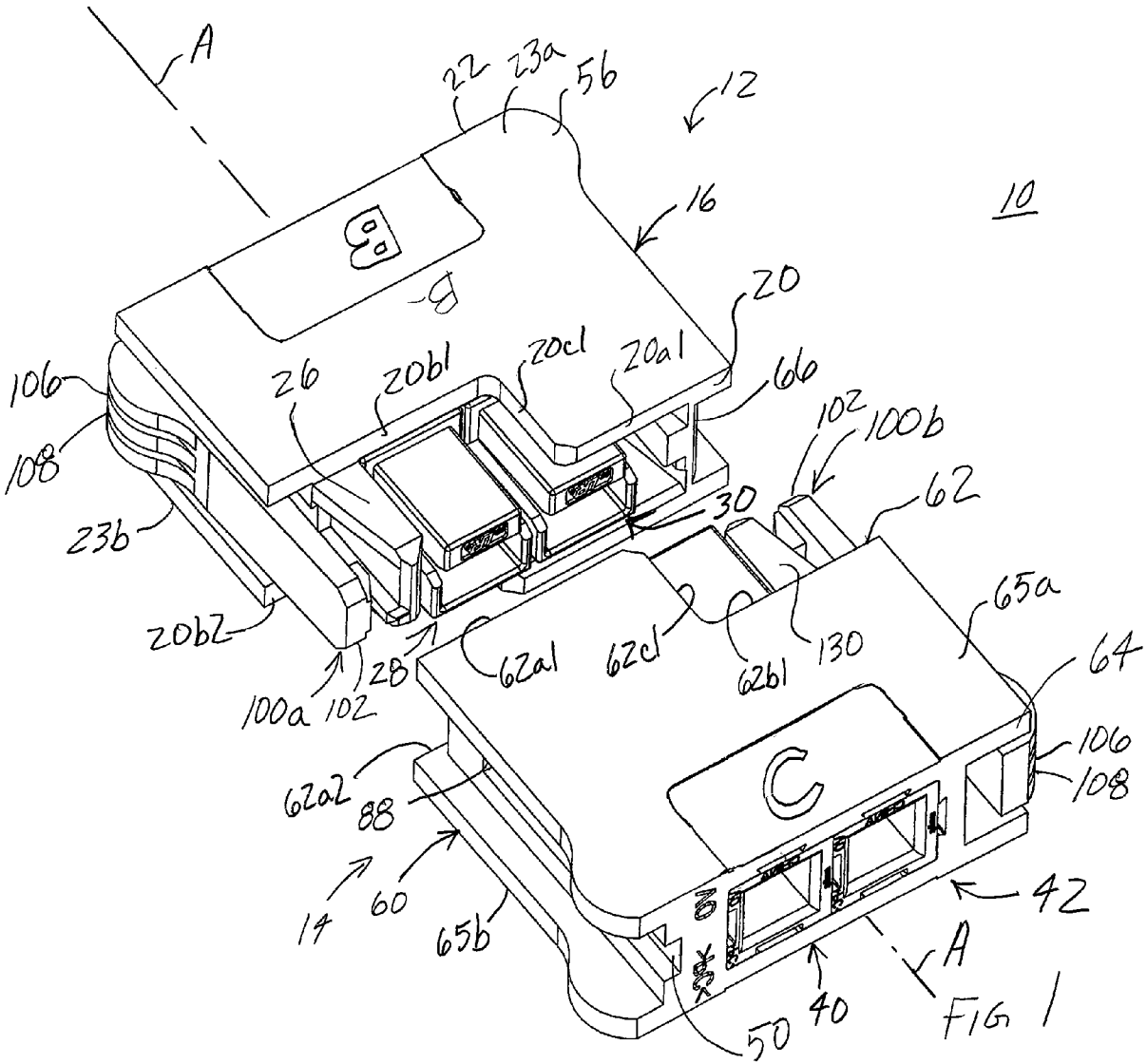
FIG. 1 is a perspective view of an electrical connector assembly according to the teachings of the present invention and showing the first and second connector housings, or the plug and the receptacle prior to mating.

The present invention is directed to an electrical connector assembly 10 as depicted in FIGS. 1–7. Electrical connector assembly 10 includes a first electrical connector or receptacle 12 and a second electrical connector or plug 14 in accordance with the present disclosure and connectable along a mating or connecting axis A. The receptacle 12 and plug 14 have insulated housings 16, 60 which are substantially identical in shape and design and include substantially complementary keying arrangements for polarizing to assure proper orientation of the receptacle 12 and plug 14 and for assuring a receptacle 12 having a particular electrical rating is mated or connected with a plug 14 having the same electrical rating.

A first keying arrangement of the electrical connector assembly 10 is provided for polarizing to assure proper orientation of receptacle 12 and plug 14. The first keying arrangement includes a retainer means having two locking tabs 100*a*, 100*b* each mounted at a respective mounting point to the insulated housings 16, 60. Each locking tab 100*a*, 100*b* is preferably integrally formed, i.e., of unitary construction, with the insulating housings 16, 60 and includes a distal end 102 configured and dimensioned for engaging respective surfaces 50, 66 defined by the insulating housings 16, 60, respectively. Each locking tab 100*a*, 100*b* is pivotable with respect to its mounting point, thereby causing it to pivot in a particular direction upon the distal end 102 contacting respective surfaces 50, 66 of housing 16, 60.

Figure 6:
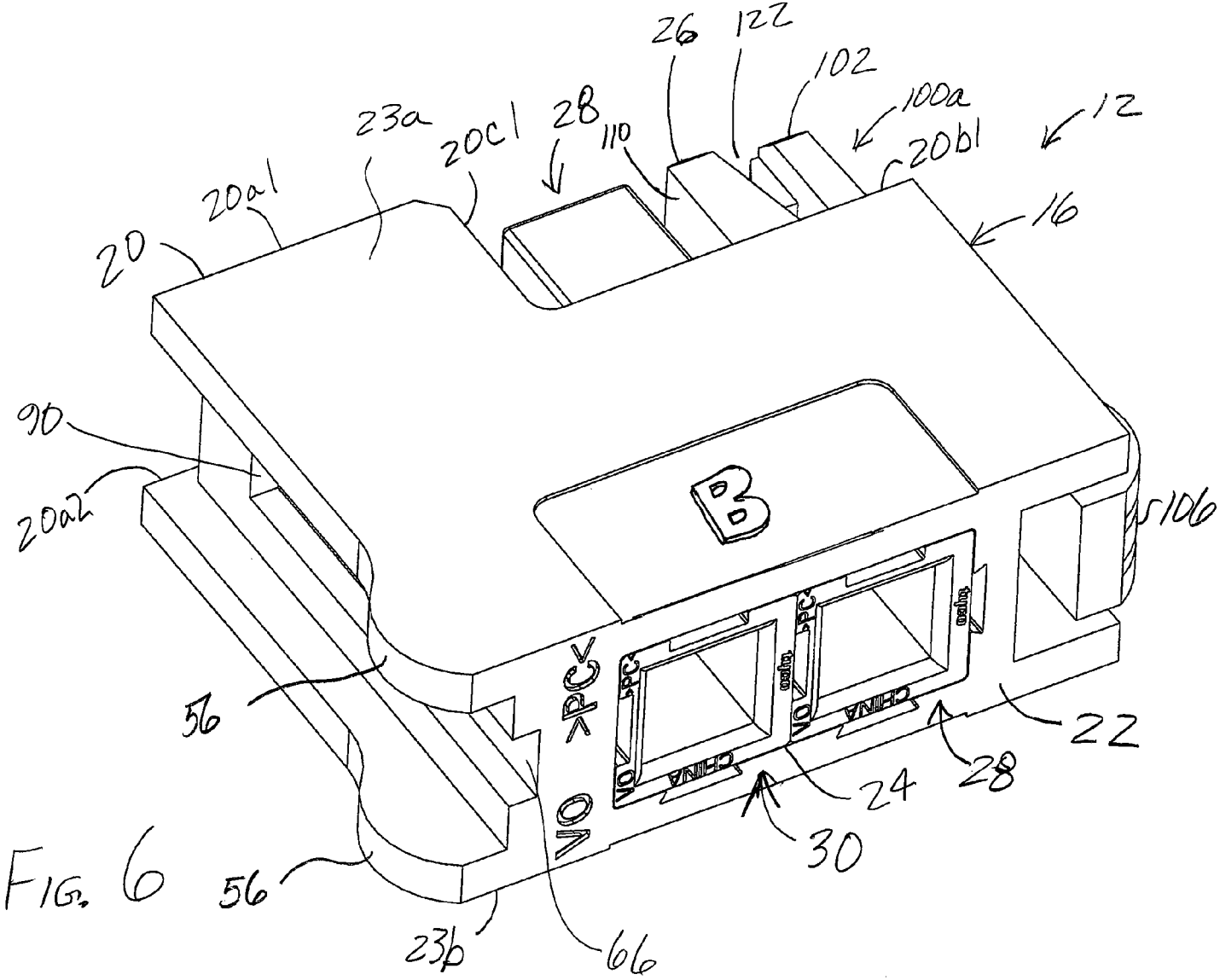
FIG. 6 is an enlarged perspective view of the receptacle shown in FIG. 1, showing the electrical connecting face thereof of the present invention.
Figure 7:
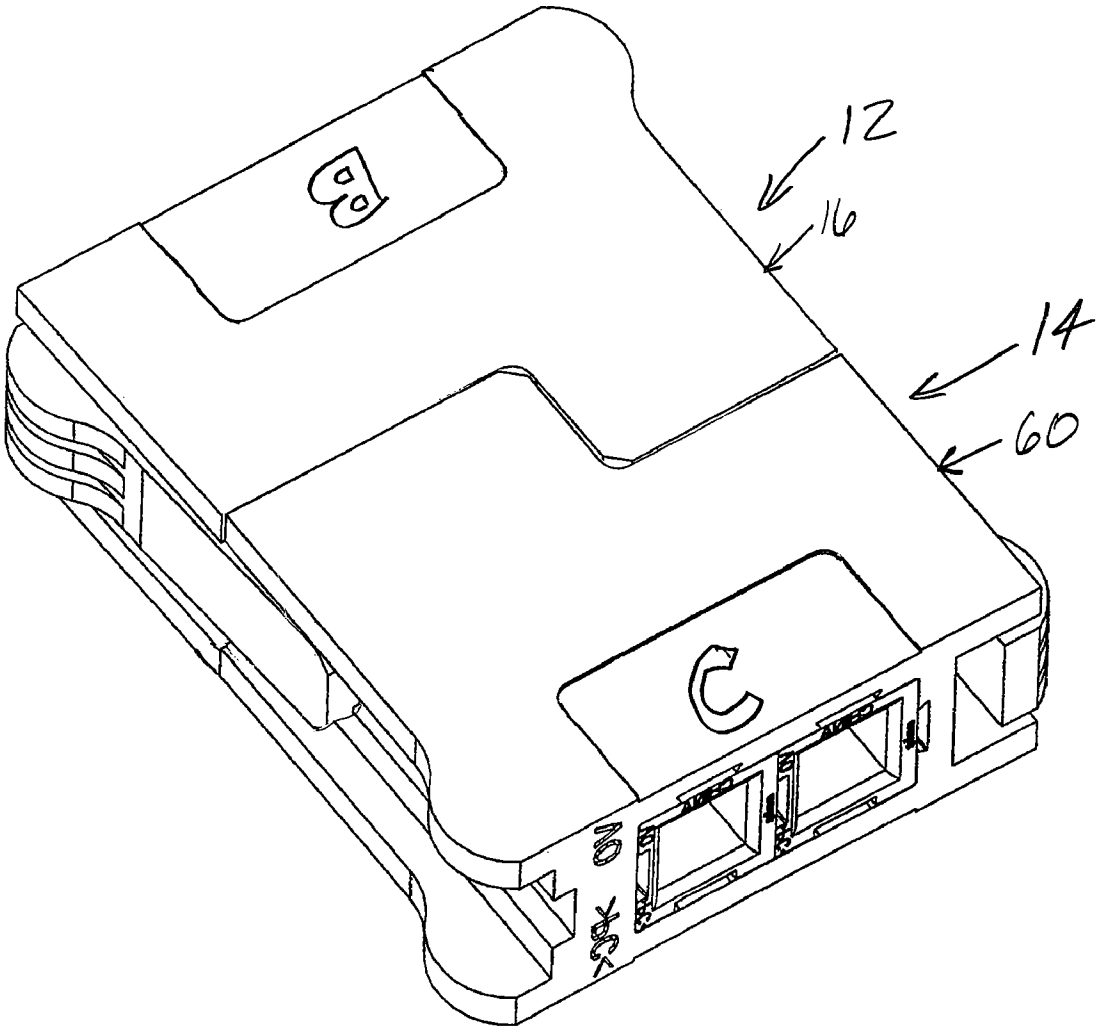
FIG. 7 is a perspective view of the plug and receptacle fully mated of the present invention.

The distal end 102 of each locking tab 100*a*, 100*b* is further configured and dimensioned for eventually pivoting opposite the particular direction for contacting in a locking configuration a surface 88 (FIGS. 1, 2, 4) of housing 16 and a surface 90 (FIG. 6) of housing 60 for mating the two housings 16, 60, as well as retaining the two housings 16, 60 in an interlocked configuration as shown by FIG. 7. If the two housings 16, 60 are not properly oriented with respect to each other or the mating axis A (FIG. 1), the two locking tabs 100*a*, 100*b* cannot engage the respective surfaces 50, 66 for enabling the mating and retention of the two housings 16, 60.

A proximal portion 106 of each locking tab 100*a*, 100*b* is raised in an arced configuration to facilitate and provide for the gripping of the insulating housings 16, 60 during connection thereof. To facilitate further gripping of the housings 16, 60, a portion of the raised proximal portion 106 of each locking tab 100*a*, 100*b* includes a plurality of slots formed therein to form gripping members 108 thereon.

Figure 5:
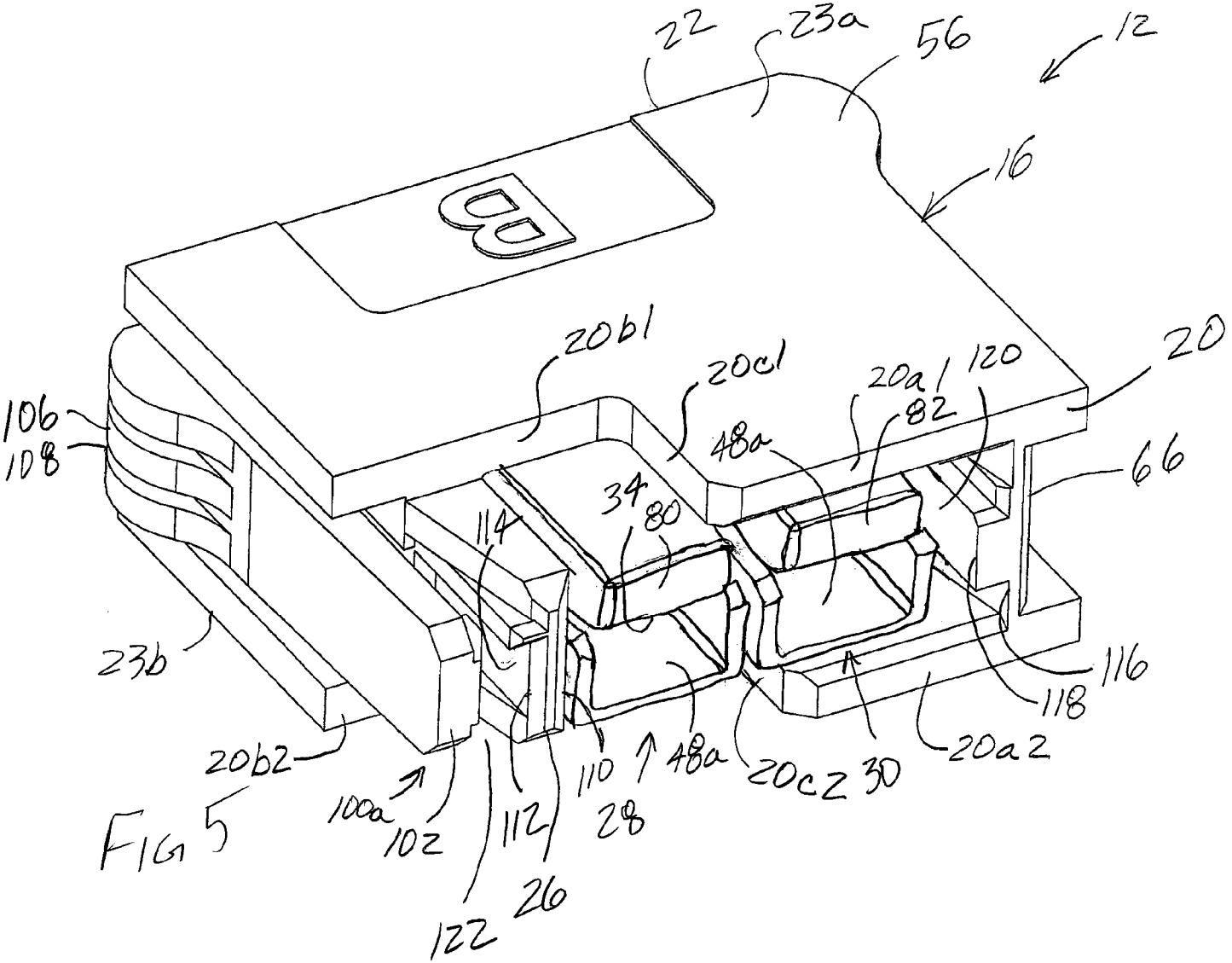
FIG. 5 is an enlarged perspective view of the receptacle shown in FIG. 1, showing the mating face thereof of the present invention.

The insulating housing 16 of the receptacle 12, as best seen in FIGS. 5 and 6, is bounded on the sides by surface 66 and locking tab 100*a*, on the ends by surfaces 20*a*1, 20*a*2, 20*b*1, 20*b*2, 22, a top wall 23*a* and a bottom wall 23*b*. Together, all the surfaces surround and define rectangular interior cavity 24 (FIG. 2) for receiving therein rectangular electrical contact housings 28, 30, respectively. Electrical contact housings 28, 30 are off-the-shelf electrical contact housings known in the art. It is contemplated, however, to custom design electrical contact housings 28, 30 and configure cavity 24 accordingly for fitting custom designed housings 28, 30 therein. Preferably, electrical contact housings 28, 30 are color coded for easily differentiating between the positive and negative terminals. It is also contemplated that that electrical contact housings 28, 30 can be variably spaced from each other as another keying feature, if desired. For example, the amount of spacing could be tied to the electrical rating, i.e., voltage, of the receptacle so that mating receptacles and plugs of different voltages cannot be mated together. However, as shown without spacing between electrical contact housings 28, 30, the electrical connector assembly can define an extremely compact construction. That is, by having the electrical contact housings 28, 30 in abutting contact, the electrical connector housing construction size is minimized. Alternately, electrical housings 28, 30 can be selectively rotated to similarly provide a keying arrangement tied to voltage, while maintaining the desired compact construction.

It is to be understood that while the electrical contact housings are shown having rectangular geometries, that other geometries can be used. Further, while color coding is often employed to distinguish contact housings from each other, markings, such as "+" or "−" can alternately be used.

End surface 20*a*1 protrudes distally from end surface 20*b*1 defining lateral surface 20*c*1 and end surface 20*a*2 protrudes distally from end surface 20*b*2 defining lateral surface 20*c*2 (FIG. 5). As shown, the electrical contact housings 28, 30 are disposed between upper and lower surfaces 23*a*, 23*b* and between end surfaces 20*a*1, 20*a*2, 22. Together the six end and lateral surfaces 20*a*1, 20*a*2, 20*b*1, 20*b*2, 20*c*1, 20*c*2 define a keying surface 20 which is part of a second keying arrangement for assuring the intended receptacle 12 is mated with the intended plug 14 and not another receptacle. For example, the second keying arrangement assures a charger receptacle is mated with a battery plug and not another charger receptacle. If an attempt is made to mate a receptacle 12 with another receptacle, keying surfaces 20 of the two receptacles 12 will not interlock along the mating axis.

A gripping member 56 extends from one end of each of the top surface 23*a* and the bottom surface 23*b* in an arced configuration to facilitate and provide for the gripping of the insulating housing 16 during mating of receptacle 12 with plug 14. The gripping members 56 are aligned on one side of the insulating housing 16 opposite gripping member 108.

Figure 3:
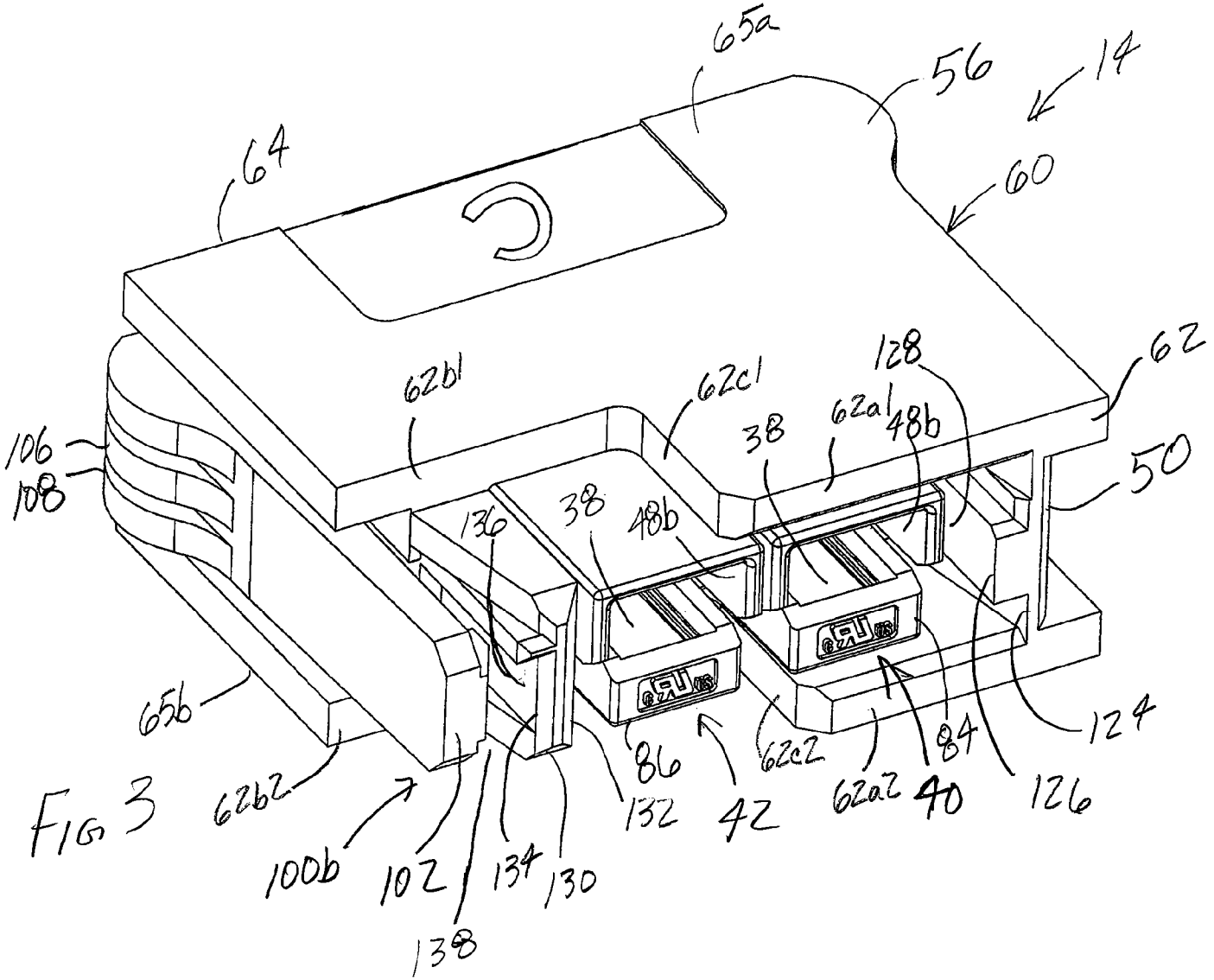
FIG. 3 is an enlarged perspective view of the plug shown in FIG. 1, showing the mating face thereof of the present invention.
Figure 4:
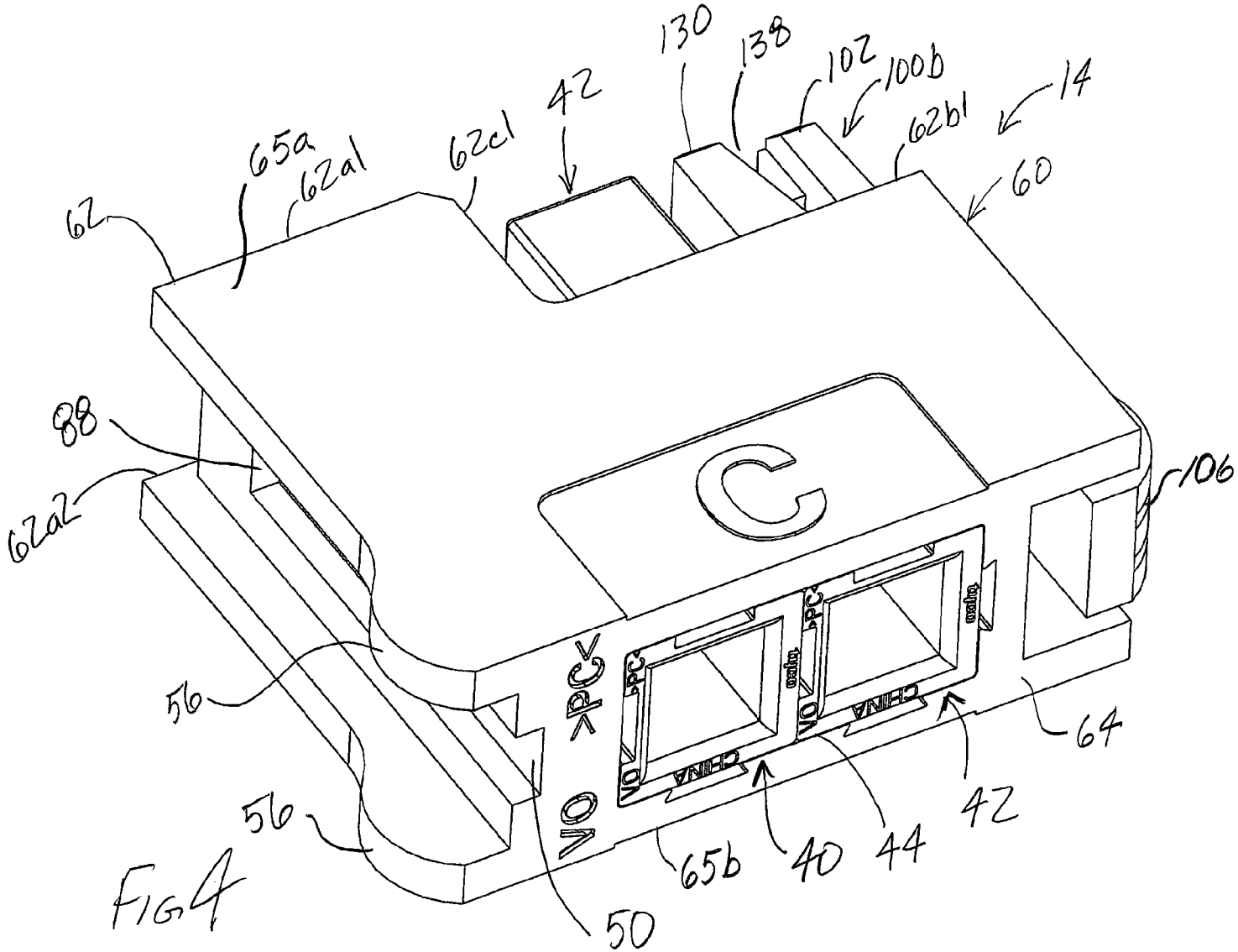
FIG. 4 is an enlarged perspective view of the plug shown in FIG. 1, showing the electrical connecting face thereof of the present invention.

The plug 14 includes an insulating housing 60, as best seen in FIGS. 3 and 4, and has a structure substantially similar to the structure of receptacle 12. Even though the structure of plug 14 is substantially similar to the structure of receptacle 12, a description of the structure of plug 14 is provided herein for complete description of electrical connector assembly 10.

Insulating housing 60 of plug 14 is bounded on the sides by surface 50 and locking tab 100*b*, on the ends by surfaces 62*a*1, 62*a*2, 62*b*1, 62*b*2, 64, a top wall 65*a* and a bottom wall 65*b*. Together, all the surfaces surround and define a rectangular interior cavity 44 (FIGS. 2 and 4) for receiving therein rectangular electrical contact housings 28, 30, respectively. Electrical contact housings 40, 42 are similar in structure to the electrical contact housings 28, 30. Electrical contact housings 40, 42 are off-the-shelf electrical contact housings known in the art. It is contemplated, however, to custom design electrical contact housings 40, 42 and configure cavity 44 accordingly for fitting custom designed housings 40, 42 therein. Preferably, electrical contact housings 40, 42 are color coded for easily differentiating between the positive and negative terminals. Optionally, separate cavities could each be formed in the housing to accommodate each electrical contact housing, but such construction would necessarily be larger than that shown, as that would require spacing the electrical contact housings from each other.

End surface 62*a*1 protrudes distally from end surface 62*b*1 defining lateral surface 62*c*1 and end surface 62*a*2 protrudes distally from end surface 62*b*2 defining lateral surface 62*c*2 (FIG. 3). The electrical contact housings 40, 42 are disposed between upper and lower surfaces 65*a*, 65*b* and between end surfaces 62*a*1, 62*a*2, 64. Together the six end and lateral surfaces 62*a*1, 62*a*2, 62*b*1, 62*b*2, 62*c*1, 62*c*2 define a keying surface 62 which is part of a second keying arrangement for assuring the intended plug 14 is mated with the intended receptacle 12 and not another receptacle. For example, the second keying arrangement assures a charger receptacle is mated with a battery plug and not another charger receptacle. If an attempt is made to mate a plug 14 with another plug, keying surfaces 62 of the two plugs 14 will not interlock along the mating axis.

A gripping member 56 extends from one end of each of the top surface 65*a* and the bottom surface 65*b* in an arced configuration to facilitate and provide for the gripping of the insulating housing 60 during mating of receptacle 12 with plug 14. The gripping members 56 are aligned on one side of the insulating housing 60 opposite gripping member 108.

Figure 2:
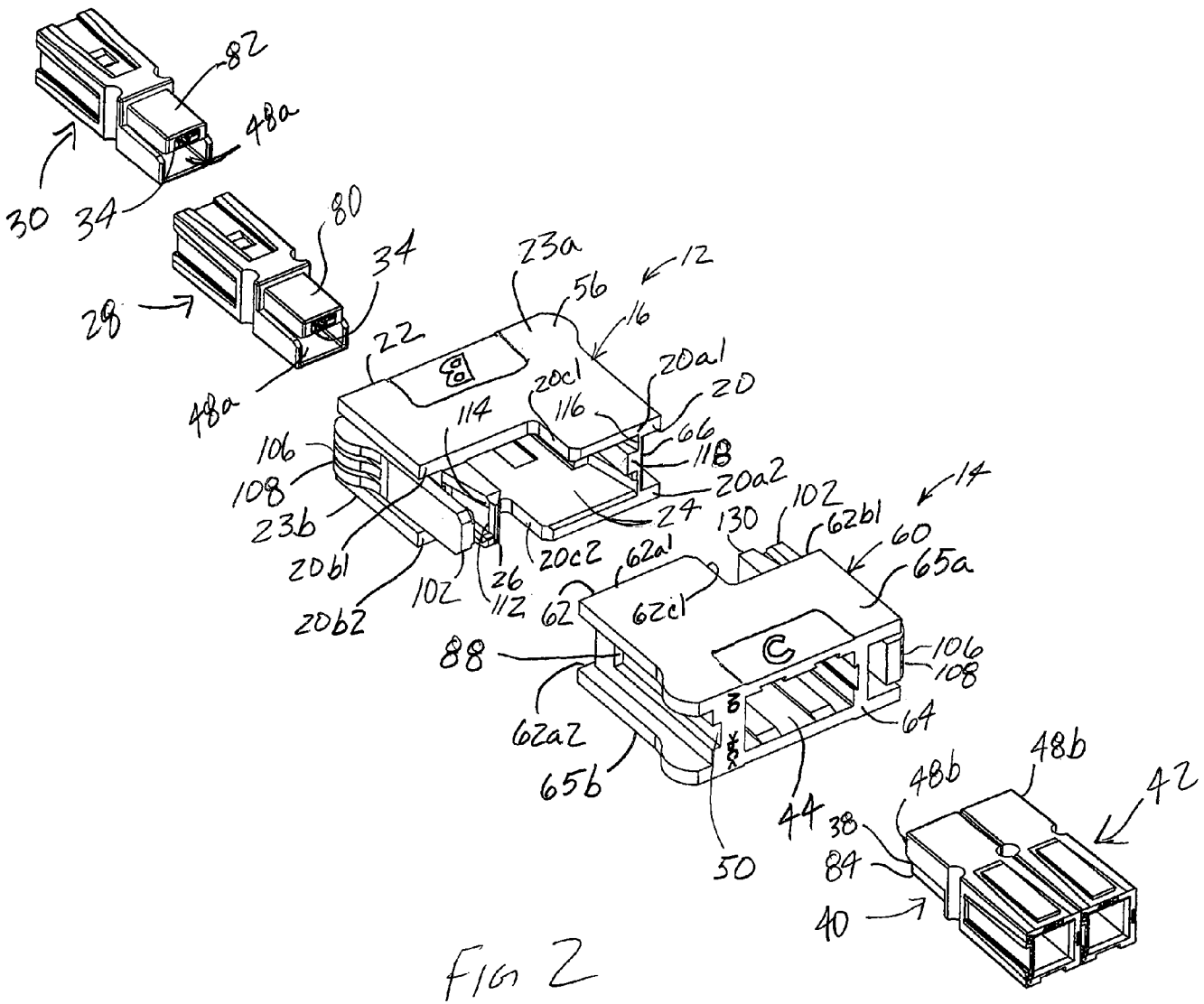
FIG. 2 is an exploded perspective view of the electrical connector assembly showing the electrical contact housings removed from the plug and receptacle of the present invention.

Interior cavity 44 and electrical contact housings 28, 30, as best seen in FIG. 2, include complementary grooves and projections configured and dimensioned for respectively engaging each other when the electrical contact housings 28, 30 are inserted within interior cavity 24. Electrical contacts 34 are provided within electrical contact housings 28, 30 of the receptacle 12 for engaging electrical contacts 38 within electrical contact housings 40, 42 of the plug 14 when the receptacle 12 is mated with the plug 14 (FIG. 7). The electrical contacts 34, 38 have wire crimps or other electrical configurations for being connected to electrical wiring. Electrical contact housings 40, 42 are configured and dimensioned for fitting within interior cavity 44 of the plug 14.

In addition to corresponding keying surfaces 20, 62 the second keying arrangement further includes a pair of additional keying surfaces to prevent inadvertent mating of electrical contacts 38 of plug 14 with electrical contacts 34 of receptacle 12. For receptacle 12, referring to FIGS. 5 and 6, a keying surface 116 opposite surface 66 has a protrusion 118 extending away from surface 66. An opening 120 is disposed between electrical contact housing 30 and keying surface 116. In addition, a protrusion 26 is disposed between upper surface 23*a* and lower surface 23*b* and also between locking tab 100*a* and electrical contact housing 28. Protrusion 26 includes a keying surface 112 having a recess 114, which keying surface of protrusion 26 is opposite to a surface 110 that faces electrical contact housing 28. An opening 122 is disposed between keying surface 112 and distal end 102 of locking tab 10*a*.

Similarly, referring to FIGS. 3 and 4, plug 14 includes a keying surface 124 opposite surface 50 having a protrusion 126 that extends away from surface 50. An opening 128 is disposed between electrical contact housing 40 and keying surface 124. In addition, a protrusion 130 is disposed between upper surface 65*a* and lower surface 65*b* and also between locking tab 100*b* and electrical contact housing 42. Protrusion 130 includes a keying surface 134 having a recess 136, which keying surface of protrusion 130 is opposite to a surface 132 that faces electrical contact housing 42. An opening 138 is disposed between keying surface 134 and distal end 102 of locking tab 110*b*.

When receptacle 12 and plug 14 are properly aligned (FIG. 1) and brought together toward each other but prior to full engagement (FIG. 7), referring to FIGS. 3–6, protrusion 130 of plug 14 is directed into opening 120 of receptacle 12 so that keying surface 134 of plug 14 and keying surface 116 of receptacle 12 become slidably engaged. During such engagement, recess 136 of plug 14 meshes with protrusion 118 of receptacle 12. Substantially simultaneously, protrusion 26 of receptacle 12 is directed into opening 128 of plug 14 so that keying surface 112 of receptacle 12 and keying surface 124 of plug 14 slidably engage. During such engagement, recess 114 of receptacle 12 meshes with protrusion 126 of plug 14. Also, distal ends 102 of locking tabs 100*a*, 100*b* slidably engage respective surfaces 50, 66. Upon full engagement of receptacle 12 and plug 14, such engagement is retained by virtue of distal ends 102 of locking tabs 100*a*, 100*b* engaging respective surfaces 88, 90. As shown, receptacle 12 and plug 14 define upper surfaces 23*a*, 65*a* with locking tabs 100*a*, 100*b* sliding along surfaces 50, 66 before engaging surfaces 88, 90. In other words, locking tabs 100*a*, 100*b* engage surfaces 50, 66 that are perpendicular to upper surfaces 23*a*, 65*a*, providing an electrical connector assembly of minimal thickness between the upper surfaces 23*a*, 65*a* and lower surfaces 23*b*, 65*b*.

It is to be understood that the distances between surface 116 and protrusion 26 of receptacle 12 and likewise between surface 124 and protrusion 130, while substantially equal to each other can be varied, acting as a further keying arrangement.

A third keying arrangement is provided by electrical connector assembly 10 to prevent inadvertent mating of electrical contacts 38 of a plug 14 having a particular electrical rating with electrical contacts 34 of a receptacle 12 having a different electrical rating as further described below. The third keying arrangement is provided in part by the two pairs of electrical contact housings 28, 30, 40, 42. Each electrical contact housing is configured and dimensioned to fit within one of the interior cavities 24, 44 defined by the surfaces of electrical connector housings 16, 60. Each electrical contact housing 28, 30 fitted within an interior cavity 24 of receptacle 12 includes a respective key 80, 82 (FIG. 5). Each key 80, 82 has a rectangular shaped outer surface that is sized to slip fit into an opposing rectangular shaped opening 48*b* (FIGS. 2 and 3) of a respective electrical contact housing 40, 42 fitted within an interior cavity 44 of plug 14 having the same electrical rating as receptacle 12.

Likewise, each electrical contact housing 40, 42 fitted within an interior cavity 44 of plug 14 includes a respective key 84, 86 (FIG. 3) having rectangular shaped outer surface that is sized to slip fit into an opposing rectangular shaped opening 48*a* (FIGS. 2 and 5) of a respective electrical contact housings 28, 30 fitted within an interior cavity 24 of receptacle 12 having the same electrical rating as plug 14. Each key is arranged so that housings 16, 60 will mate only when the four keys are in mating alignment with their respective opening and the two housings 16, 60 are in axial alignment. The retainer means provided by the first keying arrangement holds each key of the two pairs of keys in its respective opening.

To prevent inadvertent mating of electrical contacts 34 of a plug 14 having a particular electrical rating with electrical contacts 38 of a receptacle 12 having a different electrical rating, the third keying arrangement provides for the spacing between cavities 24, 44 of connector housings 16, 60 having different electrical ratings be different. Applicant's invention Ser. No. 11/051,077 of the same title, which is hereby incorporated by reference in its entirety, discloses various embodiments of this construction and will not be discussed in further detail here.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector assembly comprising:

a first and a second electrical connector connectable along a first axis, each electrical connector including a housing configured and dimensioned for receiving a pair of electrical contact housings, each electrical contact housing having electrical contacts therein, wherein each electrical contact of the first electrical connector contacts a corresponding contact of the second electrical connector during connection thereof;

a first keying arrangement for polarizing to assure proper orientation of the first electrical connector with the second electrical connector during connection thereof; and a second keying arrangement for inhibiting the connection except for connecting a first electrical connector to a designated second electrical connector, comprising:

a first keying surface defined by the first electrical connector housing and a second keying surface defined by the second electrical connector housing, where the first and second keying surfaces are substantially complementary with respect to each other for enabling connection of the first and second electrical connector housings along the first axis when the housings are in axial alignment;

a third keying surface and a fourth keying surface each extending adjacent the first keying surface of the first electrical connector; and a fifth keying surface and a sixth keying surface each extending adjacent the second keying surface of the second electrical connector, the third, fourth, fifth and sixth keying surfaces each defining an axis parallel to the first axis when the housings are in axial alignment, wherein the third keying surface engaging the fifth keying surface, and the fourth keying surface engaging the sixth keying surface when the housings are connected.

2. The electrical connector assembly according to claim 1, wherein the first and second electrical connector housings are composed of polycarbonate.

3. The electrical connector assembly according to claim 1, wherein the first and second electrical connector housings are composed of polycarbonate.

4. The electrical connector assembly according to claim 1, wherein each of the first and second keying surface includes a plurality of surfaces, wherein at least two surfaces of the plurality of surfaces are substantially perpendicular.

5. The electrical connector assembly according to claim 4, wherein at least two surfaces of the plurality of surfaces are substantially parallel.

6. The electrical connector assembly according to claim 5, wherein at least two surfaces of the plurality of surfaces are substantially coplanar.

7. The electrical connector assembly according to claim 1, further comprising locking means, wherein the locking means retains the housings in a locked configuration.

8. The electrical connector assembly according to claim 7, wherein the first electrical connector having a first outer surface and the second electrical connector having a second outer surface, the first and second outer surfaces being parallel to each other upon connection of the first and second electrical connectors, the locking means being disposed perpendicular the first and second outer surfaces.

9. The electrical connector assembly according to claim 7, wherein the locking means having a first locking tab configured and dimensioned for being received opposite one of the third or fourth keying surfaces formed in the first electrical connector housing and a second locking tab configured and dimensioned for being received opposite one of the fifth or sixth keying surfaces formed in the second electrical connector housing, each locking tab including a distal end having a surface for engaging a surface substantially opposite one of the first and second keying surfaces.

10. The electrical connector assembly according to claim 1, wherein each electrical contact housing includes a key comprising an offset portion extending forwardly from a rear portion of the first or second keying surface and being substantially flush with a forward portion of the first or second keying surface when the electrical contact housings are in axial alignment, whereby the electrical contact housings fitted within the first and second electrical connectors are substantially identical and provide a third keying arrangement.

11. The electrical connector assembly according to claim 10, wherein the electrical contacts are provided on at least one surface of each of the keys.

12. The electrical connector assembly according to claim 1, further comprising locking means, wherein the locking means retains the housings in a locked configuration.

13. The electrical connector assembly according to claim 12, wherein the locking means having a first locking tab configured and dimensioned for being received opposite one of the first pair of keying surfaces formed in the first electrical connector housing and a second locking tab configured and dimensioned for being received opposite one of the second pair of keying surfaces formed in the second electrical connector housing, each locking tab including a distal end having a surface for engaging a surface substantially opposite one of the first and second keying surfaces.

14. An electrical connector assembly comprising:

a first and a second electrical connector connectable along an axis, each electrical connector including a housing configured and dimensioned for receiving a pair of electrical contact housings, each electrical contact housing having electrical contacts therein, wherein each electrical contact of the first electrical connector contacts a corresponding contact of the second electrical connector during connection thereof;

a first keying arrangement for polarizing to assure proper orientation of the first electrical connector with the second electrical connector during connection thereof; and a second keying arrangement for inhibiting the connection except for connecting a first electrical connector to a designated second electrical connector, comprising:

a first keying surface defined by the first electrical connector housing and a second keying surface defined by the second electrical connector housing, where the first and second keying surfaces are substantially complementary with respect to each other for enabling connection of the first and second electrical connector housings along the axis when the housings are in axial alignment;

a first pair of keying surfaces extending adjacent the first keying surface of the first electrical connector; and a second pair of keying surfaces extending adjacent the second keying surface of the second electrical connector, the first pair of keying surfaces and corresponding second pair of keying surfaces being in axial alignment when the housings are in axial alignment, wherein the first pair of keying surfaces engaging the corresponding second pair of keying surfaces when the housings are connected.

15. The electrical connector assembly according to claim 14, wherein the first electrical connector having a first outer surface and the second electrical connector having a second outer surface, the first and second outer surfaces being parallel to each other upon connection of the first and second electrical connectors, the locking means being disposed perpendicular the first and second outer surfaces.

16. The electrical connector assembly according to claim 14, wherein each electrical contact housing includes a key comprising an offset portion extending forwardly from a rear portion of the first or second keying surface and being substantially flush with a forward portion of the first or second keying surface when the electrical contact housing is slip fit into the corresponding opening, whereby the electrical contact housings fitted within the first and second electrical connectors are substantially identical and provide a third keying arrangement.

17. The electrical connector assembly according to claim 14, wherein the first and second electrical connectors are hermaphroditic.

18. The electrical connector assembly according to claim 14, wherein each of the first and second keying surface includes a plurality of surfaces, wherein at least two surfaces of the plurality of surfaces are substantially perpendicular.

19. The electrical connector assembly according to claim 18, wherein at least two surfaces of the plurality of surfaces are substantially parallel.

20. The electrical connector assembly according to claim 19, wherein at least two surfaces of the plurality of surfaces are substantially coplanar.

* * * * *